US007055497B2

(12) United States Patent
Maehara et al.

(10) Patent No.: US 7,055,497 B2
(45) Date of Patent: Jun. 6, 2006

(54) MULTI-CYLINDER INTERNAL COMBUSTION ENGINE

(75) Inventors: Hayato Maehara, Saitama (JP); Takaaki Tsukui, Saitama (JP); Kazuhito Hotta, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/956,031

(22) Filed: Oct. 4, 2004

(65) Prior Publication Data

US 2005/0133004 A1 Jun. 23, 2005

(30) Foreign Application Priority Data

Oct. 6, 2003 (JP) ..... 2003-347552

(51) Int. Cl.
*F02D 1/00* (2006.01)
*F01N 3/00* (2006.01)

(52) U.S. Cl. ..... 123/336; 123/399; 123/442

(58) Field of Classification Search ..... 123/336, 123/337, 399, 400, 442
See application file for complete search history.

(56) References Cited

U.S. PATENT DOCUMENTS

| | | | | |
|---|---|---|---|---|
| 4,256,063 | A | 3/1981 | Sumiyoshi et al. | |
| 6,196,186 | B1 | 3/2001 | Nagasaka et al. | |
| 6,622,695 | B1 * | 9/2003 | Kondo | 123/336 |
| 2004/0237934 | A1 * | 12/2004 | Tsukui et al | 123/336 |
| 2005/0153816 | A1 * | 7/2005 | Yoda et al. | 477/111 |
| 2005/0155571 | A1 * | 7/2005 | Hanasato | 123/336 |
| 2005/0211220 | A1 * | 9/2005 | Matsuda | 123/336 |

FOREIGN PATENT DOCUMENTS

| | | | |
|---|---|---|---|
| JP | 2002-256895 | A | 9/2002 |
| JP | 2003-227357 | A | 8/2003 |

OTHER PUBLICATIONS

JP 2002-256895 A Sep. 11, 2002—Abstract Only.

* cited by examiner

*Primary Examiner*—Hai Huynh
(74) *Attorney, Agent, or Firm*—Birch, Stewart, Kolasch & Birch, LLP

(57) ABSTRACT

In a multi-cylinder internal combustion engine having throttle valves to be opened and closed by electric motors, output control is enabled in various ways according to the state of usage of an object to be driven by the multi-cylinder internal combustion engine with a simple structure with the scope of application of shared components being expanded to reduce the cost. In addition, a throttle body assembly is downsized in the direction of the arrangement of the cylinders. A multi-cylinder internal combustion engine includes a predetermined number of cylinders, a throttle body assembly including the throttle bodies formed with intake-air channels and throttle valves. The respective throttle valves are opened and closed by the electric motors provided independently for each throttle valve. Air-intake ports of the first and fourth cylinders are formed so as to approach a center plane in the direction of the arrangement as they approach entrances.

21 Claims, 3 Drawing Sheets

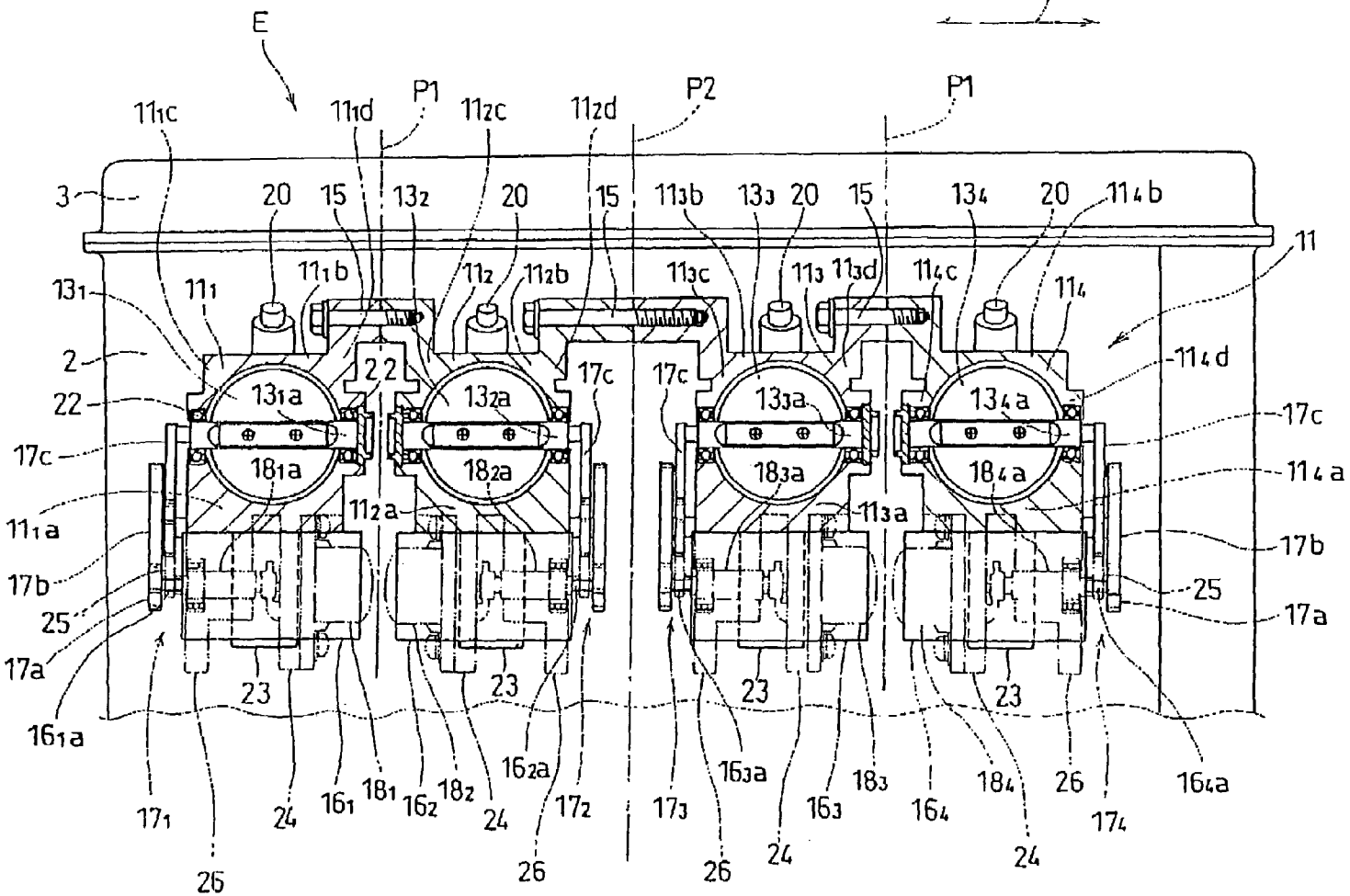
A1
E
P1
P2
P1
11
11d
11c
11b
11a
11d
11c
11b
11a
11d
11c
11b
11a
11
11
11

MULTI-CYLINDER INTERNAL COMBUSTION ENGINE

CROSS-REFERENCE TO RELATED APPLICATIONS

The present non-provisional application claims priority under 35 USC 119 to Japanese Patent Application No. 2003-347552 filed on Oct. 6, 2003 the entire contents thereof is hereby incorporated by reference.

BACKGROUND OF THE INVENTION

1. Field of the Invention

The present invention relates to a multi-cylinder internal combustion engine in which throttle valves disposed in air-intake channels formed independently for each cylinder are opened and closed by an electric motor.

2. Description of Background Art

A multi-cylinder internal combustion engine is known wherein throttle valves are opened and closed by an electric motor, for example, see JP-A-2002-256895. The four-cylinder internal combustion engine includes throttle valves provided for each cylinder. The four throttle valves are opened and closed by a single drive motor or are divided into two groups each having two throttle valves with the two throttle valves in each group being opened and closed by a single drive motor.

In the related art, a plurality of throttle valves are driven by a single drive motor. Thus, the output control for each cylinder cannot be performed. Therefore, it is difficult to control the output of the multi-cylinder internal combustion engine in various ways depending on the state of usage of the object to be driven, such as a vehicle. For example, in a variable cylinder internal combustion engine in which the operating state can be switched between a full cylinder operation in which all the cylinders are activated and a partial cylinder operation in which part of the cylinders come to halt, it is necessary to control the opening of each throttle valve in each cylinder in order to reduce torque disalignment in association with the switching of the operating state. However, in the related art described above, it is difficult to perform the output control for each cylinder to satisfy such requirement. Since a plurality of throttle valves are grouped into one set, the arrangement or the number of cylinders to which the throttle valves to be driven by the drive motor are applied is limited, and hence the multi-cylinder internal combustion engine, to which shared components are applied, is limited. In addition, there is a problem as to how an opening sensor for detecting the opening of the throttle valve, which is necessary for driving the throttle valve by the drive motor, can be compactly arranged.

SUMMARY AND OBJECTS OF THE INVENTION

In view of such circumstances, it is an object of the present invention to provide a multi-cylinder internal combustion engine including throttle valves to be opened and closed by an electric motor, in which a cost reduction is achieved by providing a simple structure for enabling various types of output controls according to the state of usage of an object to be driven by the internal combustion engine. In addition, the scope of application of the shared components is expanded and a downsizing of a throttle body assembly in the direction of the arrangement is obtained.

Further, the present invention increases the flexibility of the arrangement of an opening sensor for detecting the opening of the throttle valve to enable, for example, a compact arrangement of the opening sensor.

The present invention is directed to a multi-cylinder internal combustion engine wherein a predetermined plurality of cylinders are provided with cylinder arrays including two or more of the cylinders disposed in series. A throttle body assembly includes the predetermined number of throttle body formed with air-intake channels in communication with air-intake ports formed for each cylinder in a cylinder head. The throttle valves are disposed in the respective air-intake channels, wherein the respective throttle valves are opened and closed by the electric motors provided independently for the respective throttle valves. The air-intake ports belonging to end cylinders, which are located at the ends of the cylinder array in the direction of the arrangement of the cylinders of the cylinder array, are formed so as to approach a plane positioned at the center of the cylinder array in the direction of the arrangement, which is a center plane orthogonal to the direction of the arrangement, as they approach an entrance thereof.

Accordingly, since the respective throttle valves are opened and closed by the electric motors which are not shared by other throttle valve, the openings of the individual throttle valves can be controlled independently without employing a complex mechanical operating mechanism in comparison with the case in which the throttle valves are opened and closed by the mechanical operating mechanism using a cable or the like. In addition, a constraint due to the alignment of the number of cylinders of the multi-cylinder internal combustion engine provided with throttle valves to be opened and closed by the electric motor is reduced, thereby increasing the range of usage of the shared component. Furthermore, since the throttle bodies, which belong to the cylinders at both ends, have the air-intake channel in communication with the air-intake ports approaching at the portion near the entrances toward the center plane, it may be disposed close to the center plane in the direction of the arrangement of the cylinders. Thus, the width of the throttle body assembly in the direction of the arrangement can be reduced.

In addition to the multi-cylinder internal combustion engine according to the invention is characterized in that the electric motors and the throttle valves belonging to the respective cylinders of the cylinder array are arranged in parallel in the direction of the arrangement. Thus, the driving force transmitting mechanisms for transmitting a driving force of the electric motors to the throttle valve are arranged in series with the electric motors and the throttle valves in the direction of the arrangement, and the electric motors and the throttle valves belonging respectively to the cylinders at both ends are positioned between the driving force transmitting mechanisms belonging respectively to the cylinders at both ends.

Accordingly, the electric motors and the throttle valves belonging to the respective cylinders of the cylinder array are arranged in parallel in the direction of the arrangement and, as regards the cylinders at both ends of the cylinder array, since the respective driving force transmitting mechanisms disposed in series with the electric motors and the throttle valves are disposed outside of the electric motors and the throttle valves in the direction of the arrangement, the number of the driving force transmitting mechanisms to be disposed between the throttle valves at both ends is reduced. Thus, the width of the throttle body assembly in the direction of the arrangement can be reduced.

In addition to the multi-cylinder internal combustion engine the present invention further includes opening sensors for detecting an opening for each throttle valves wherein each opening sensor detects the opening of the throttle valve through the driving force transmitting mechanism for transmitting the driving force of the electric motor to the throttle valve.

Accordingly, since the opening sensor can detect the opening of the throttle valve from a given position in the driving force transmitting mechanism, the flexibility of the opening sensor is increased.

According to the present invention, the following effects are achieved. Since the opening control of the individual throttle valve can be performed independently without employing a complex mechanical operating mechanism, the output control can be performed in various ways according to the state of usage of the object to be driven by the multi-cylinder internal combustion engine while getting maximum benefit from such advantage that the throttle valves are opened and closed by the electric motors. In addition, since the scope of usage of the components shared by the multi-cylinder internal combustion engine having the throttle valves to be opened and closed by the electric motors is expanded, a reduction in the cost of the multi-cylinder internal combustion engine is achieved. Furthermore, since the width of the throttle body assembly in the direction of the arrangement can be reduced, the throttle body assembly can be downsized in the direction of the arrangement.

According to the present invention, since the electric motors and the throttle valves belonging to the respective cylinders of the cylinder array are disposed in parallel in the direction of the arrangement, and the width of the throttle body assembly in the direction of the arrangement can be reduced, the throttle body assembly can be downsized in the direction of the arrangement from this point of view as well.

According to the present invention, since the flexibility of the opening sensor is increased, the opening sensor can be compactly arranged in the periphery of the throttle body assembly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3 is a cross-sectional view taken along the arrows III—III in FIG. 1.

DETAILED DESCRIPTION OF THE PREFERRED EMBODIMENTS

Figure 1:
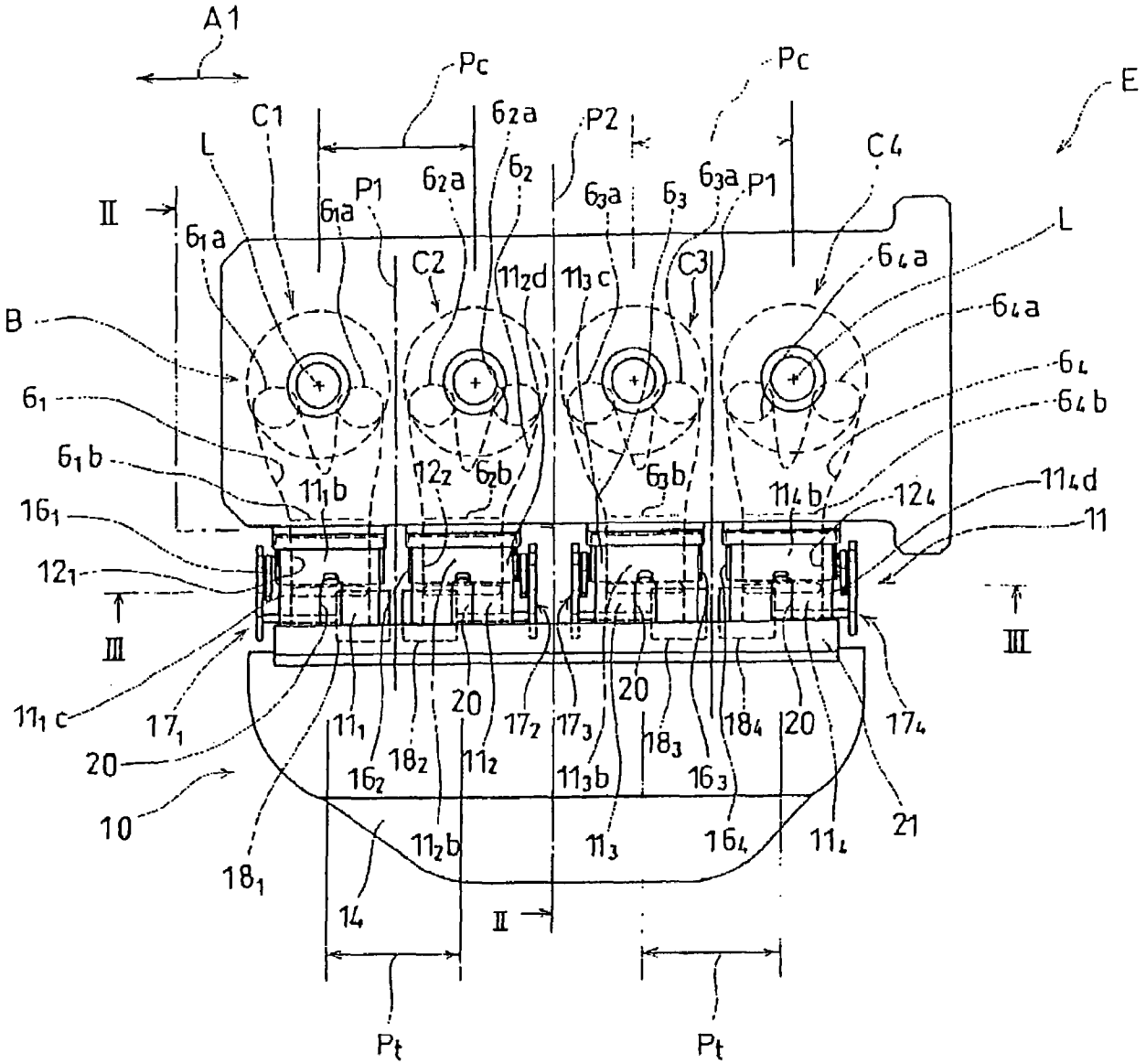
FIG. 1 is a schematic plan view of a multi-cylinder internal combustion engine according to an embodiment of the present invention.
Figure 2:
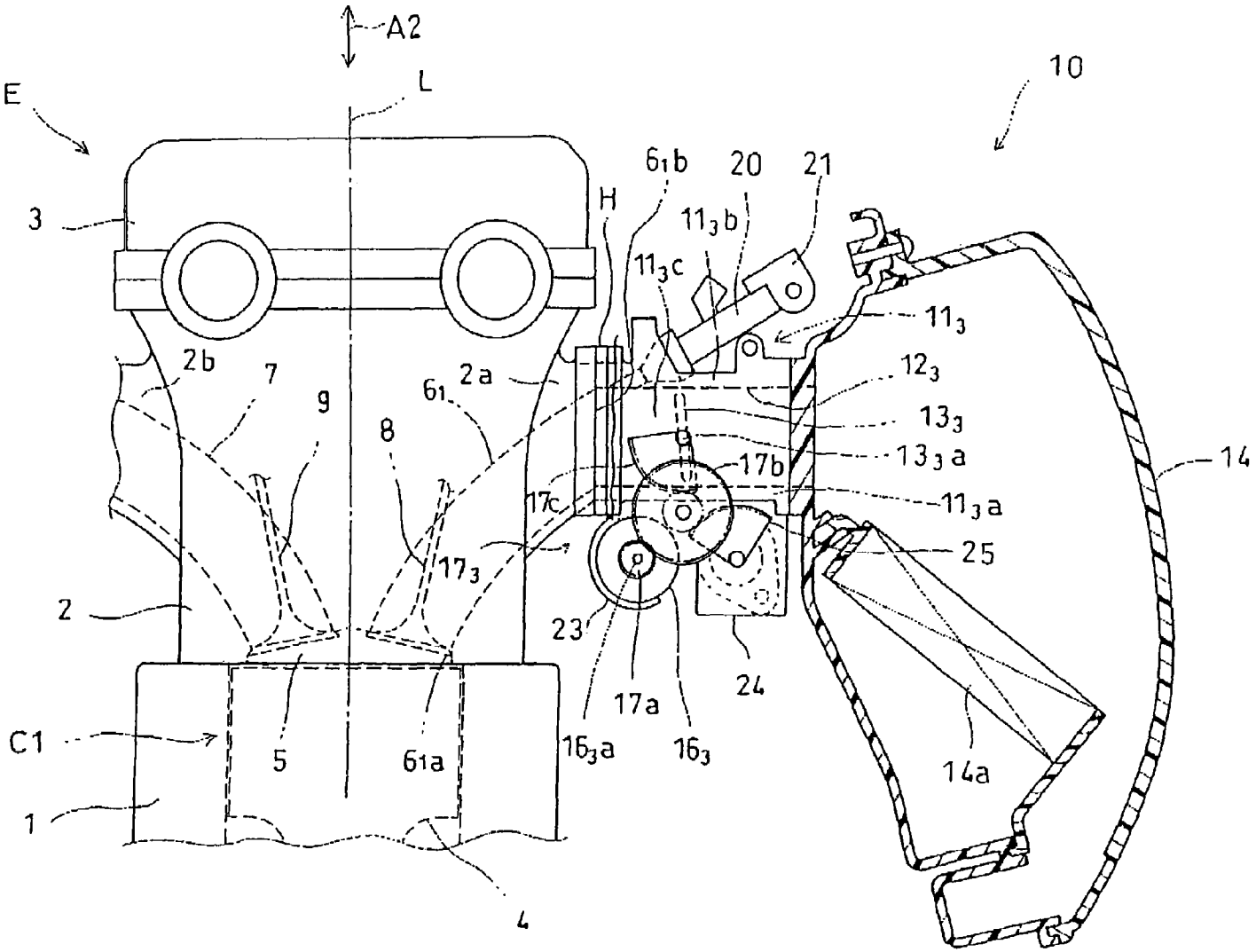
FIG. 2 is a side view partly shown in cross-section taken along the arrows II—II in FIG. 1.

Referring now to FIG. 1 to FIG. 3, an embodiment of the present invention will be described wherein FIG. 1 and FIG. 2 illustrate a multi-cylinder internal combustion engine E to which the present invention is applied. The multi-cylinder internal combustion engine E is a four-stroke internal combustion engine including a cylinder array B having a predetermined plurality of cylinders, four cylinders C1–C4 in this case, disposed in series. The multi-cylinder internal combustion engine E is mounted to a vehicle, such as a motorcycle, in the direction in which a crankshaft is oriented in the direction of the width of the vehicle, which corresponds to the lateral direction of the vehicle, that is, in a transverse arrangement. In the following description, the terms front, rear, left and right corresponds to the front, rear, left and right of the vehicle. The internal combustion engine E is also a variable cylinder internal combustion engine including a publicly known valve-halting mechanism for halting part of the cylinders C2, C3 in a low load operating range.

The internal combustion engine E is provided with an engine body including a cylinder block 1 having integrally formed the four cylinders C1–C4, a cylinder head 2 connected at the upper end of the cylinder block 1, a head cover 3 connected to the upper end of the cylinder head 2 and a crankcase (not shown) connected to the lower end of the cylinder block 1 for rotatably supporting the crankshaft.

A piston 4, fitted to the respective cylinders C1–C4 so as to be capable of reciprocal movement, is driven by combustion gas generated when air-fuel mixture is burned in a combustion chamber 5, described later, for rotating the crankshaft via a connecting rod. The cylinder head 2 includes combustion chamber 5 corresponding to the respective cylinders C1–C4, air-intake ports $\mathbf{6}_1$–$\mathbf{6}_4$ having pairs of suction ports $\mathbf{6}_1a$–$\mathbf{6}_4a$ opening to the respective combustion chambers 5 and exhaust ports 7 having pairs of exhaust slots 7*a* opening to the respective combustion chambers 5. Furthermore, the cylinder head 2 includes pairs of air-intake valves 8 for opening and closing the pairs of suction ports $\mathbf{6}_1a$–$\mathbf{6}_4a$, respectively, a pair of exhaust valves 9 for opening and closing the pairs of exhaust slots 7*a* and an ignition plug stored in a storing cylinder 3*a* formed in the head cover 3 and exposed in the combustion chambers 5 for each combustion chamber 5.

An air-intake unit 10 is provided for introducing sucked air into the respective air-intake ports $\mathbf{6}_1$–$\mathbf{6}_4$ on a rear wall 2*a*, which is one of side walls of the cylinder head 2 on which entrances $\mathbf{6}_1b$–$\mathbf{6}_4b$ of the respective air-intake ports $\mathbf{6}_1$–$\mathbf{6}_4$ is formed. On the other hand, an exhaust unit having an exhaust pipe (not shown) including an exhaust channel to be connected to the respective exhaust ports 7 formed therein is attached to a front wall 2*b*, which corresponds to another side wall of the cylinder head 2 to which exits of the respective exhaust ports 7 open, so that exhaust gas discharged from the combustion chambers 5 and passed through the exhaust ports 7 is discharged toward the outside through the exhaust unit.

The air-intake unit 10 includes a throttle body assembly 11 having four air-intake channels $\mathbf{12}_1$–$\mathbf{12}_4$ independent for each cylinders C1–C4 and being connected to the rear wall 2*a* of the cylinder head 2, throttle valves $\mathbf{13}_1$–$\mathbf{13}_4$ provided in the throttle body assembly 11 and disposed in each air-intake channels $\mathbf{12}_1$–$\mathbf{12}_4$ and an air cleaner 14 having a filtering element 14*a* for cleaning intake air to be introduced to the air-intake channels $\mathbf{12}_1$–$\mathbf{12}_4$. The air-intake unit 10 is connected to the upstream end of the throttle body assembly 11.

Referring to FIG. 3, the throttle body assembly 11 includes four separate throttle bodies $\mathbf{11}_1$–$\mathbf{11}_4$ disposed in series in the direction of the arrangement A1 of the cylinders C1–C4. The throttle bodies $11_1$–$11_2$; $11_2$–$11_3$; $11_3$–$11_4$ adjacent in the direction of the arrangement A1 are connected with bolts 15. The respective throttle bodies $11_1$–$11_4$ are attached to the rear wall 2*a* of the cylinder head 2 via an insulator H so that the air-intake channels $12_1$–$12_4$ communicate with the air-intake ports $6_1$–$6_4$, and the lower ends of the respective air-intake channels $12_1$–$12_4$ are connected to the entrances $6_1b$–$6_4b$ of the air-intake port $6_1$–$6_4$.

The air-intake ports $6_1$; $6_4$ belong to first and fourth cylinders C1; C4, which correspond to end cylinders located at both ends of the cylinder array B in the direction of the arrangement A1. The air-intake ports $6_2$; $6_3$ belong to second and third cylinders $C_2$; $C_3$, which correspond to the adjacent cylinders adjacent to the first and fourth cylinders C1; C4 in the direction of the arrangement A1. The air-intake ports $6_1$, $6_2$; $6_4$, $6_3$ are formed in such a manner that they approach symmetry planes P1 in the direction of the arrangement A1 as they approach the entrances $6_1b$, $6_2b$; $6_4b$, $6_3b$. Here, the symmetry planes P1 are symmetry planes of the both cylinders C1, C2; C4, C3 located between the first and fourth cylinders C1; C4 and the second and third cylinders C2; C3 in the direction of the arrangement A1 out of the planes orthogonal to the direction of the arrangement A1 and are located between the first and second cylinders C1, C2 between the throttle bodies $11_1$, $11_2$, between the fourth and third cylinders C4, C3 between the throttle bodies $11_4$, $11_3$. Therefore, both of the air-intake ports $6_1$, $6_2$; $6_4$, $6_3$ are formed so as to be located at the positions of mirror images with respect to the symmetry planes P1, so that both of the air-intake ports $6_1$, $6_2$; $6_4$, $6_3$ approach each other as they approach the entrances $6_1b$, $6_2b$; $6_4b$, $6_3b$.

Consequently, a pitch Pt between both throttle bodies $11_1$, $11_2$; $11_4$, $11_3$ is smaller than a cylinder-to-cylinder pitch Pc between both cylinders C1, C2; C4, C3. Here, the pitch Pc represents a distance between cylinder axes L in the direction of the arrangement A1 when viewed in the direction A2 (See FIG. 1, hereinafter referred to as the direction of cylinder axis A2) in which a cylinder axis L extends and the pitch Pt represents a distance between the center axes of the throttle bodies $11_1$, $11_2$; $11_4$, $11_3$ (they are also center axes of the intake-air channels $12_1$, $12_2$; $12_4$, $12_3$) in the direction of the arrangement A1 when viewed in the direction of the cylinder axis A2.

The air-intake ports $6_1$; $6_4$ belonging to the first and fourth cylinders C1; C4 are formed so as to approach the air-intake ports $6_2$; $6_3$ belonging to the second and third cylinders C2, C3 as they approach the entrances $6_1b$; $6_4b$ in the direction of the arrangement A1 and to approach the center plane P2 in the direction of the arrangement A1.

The respective throttle bodies $11_1$–$11_4$ formed with the air-intake channels $12_1$–$12_4$ include the throttle valves $13_1$–$13_4$ for controlling the flow rate of intake air flowing through the air-intake channels $12_1$–$12_4$, electric motors $16_1$–$16_4$ for driving the throttle valves $13_1$–$13_4$ and opening and closing the same, driving force transmitting mechanisms $17_1$–$17_4$ for transmitting the driving force of the electric motors $16_1$–$16_4$ to the throttle valves $13_1$–$13_4$, opening sensors $18_1$–$18_4$ for detecting the opening of the throttle valves $13_1$–$13_4$ and fuel injection valves 20 as a fuel supplying unit for supplying fuel mixed with the intake air for forming an air-fuel mixture. Therefore, the throttle valves $13_1$–$13_4$, the electric motors $16_1$–$16_4$, the driving force transmitting mechanisms $17_1$–$17_4$, the opening sensors $18_1$–$18_4$ and the fuel injection valves 20, which proceed in the internal combustion engine E are provided independently for the respective cylinder C1–C4.

The respective throttle valves $13_1$–$13_4$ for controlling the flow rate of the intake air and controlling the output of the internal combustion engine E are formed of butterfly valves and are provided with valve shafts $13_1a$–$13_4a$ rotatably supported by the throttle bodies $11_1$–$11_4$ via bearings 22. The valve shafts $13_1a$–$13_4a$ are disposed in parallel with the direction of the arrangement A1 and the throttle valves $13_1$–$13_4$ are disposed in series in the direction of the arrangement A1.

In the respective throttle bodies $11_1$–$11_4$, the electric motors $16_1$–$16_4$, the opening sensors $18_1$–$18_4$, and the fuel injection valves 20 are disposed in parallel with the throttle valves $13_1$–$13_4$ and the air-intake channels $12_1$–$12_4$ in the direction of the arrangement A1. The driving force transmitting mechanisms $17_1$–$17_4$ are disposed in series with the throttle valves $13_1$–$13_4$ and the air-intake channels $12_1$–$12_4$ in the direction of the arrangement A1. On one of the side walls of the throttle bodies $11_1$–$11_4$ which is oppose to the throttle bodies $11_1$–$11_4$ with the intermediary of the air-intake channels $12_1$–$12_4$ when viewed in the direction of the arrangement A1, that is, in this embodiment, on the side of lower walls $11_1a$–$11_4a$, there are disposed electric motors $16_1$–$16_4$ and opening sensors $18_1$–$18_4$ for detecting the opening of the throttle valves $13_1$–$13_4$. On the other side wall, that is, in this embodiment, on the side of upper walls $11_1b$–$11_4b$, there are disposed fuel injection valves 20 and delivery pipes 21 to which the respective fuel injection valves 20 are connected.

On the side of the lower walls $11_1a$–$11_4a$ of the respective throttle bodies $11_1$–$11_4$, the electric motors $16_1$–$16_4$ and the opening sensors $18_1$–$18_4$ are disposed in series in the elongated direction of the air-intake channels $12_1$–$12_4$ at the same positions with respect to the lower walls $11_1a$–$11_4a$. Then, as shown in FIG. 3, in the direction of the arrangement A1, substantially the entirety of the respective electric motors $16_1$–$16_4$ and substantially the entirety of the respective opening sensors $18_1$–$18_4$ including driven shafts $18_1a$–$18_4a$, described later, are located at the positions overlapping with the throttle bodies $11_1$–$11_4$.

The electric motors $16_1$–$16_4$ located below the throttle bodies $11_1$–$11_4$ are attached to the throttle bodies $11_1$–$11_4$ via stays 23. The electric motors $16_1$–$16_4$ provided with drive shafts $16_1a$–$16_4a$ in the direction of the arrangement A1 and in parallel with the valve shafts $13_1a$–$13_4a$ are controlled by an ECU, describe later, and open and close the throttle valves $13_1$–$13_4$ according to the amount of operation of the accelerator due to the driver and the respective operating states of the internal combustion engine E and the vehicle.

Referring now to FIG. 2, the driving force transmitting mechanisms $17_1$–$17_4$ for transmitting driving force of the drive shafts $16_1a$–$16_4a$ to the valve shafts $13_1a$–$13_4a$ are gear mechanisms provided with gear trains constituting speed reducing gear mechanisms. The gear trains each include an input gear 17*a* provided on each of the drive shafts $16_1a$–$16_4a$, an intermediate gear 17*b* having a large gear which engages the input gear 17*a* and are rotatably supported with respect to each of the throttle bodies $11_1$–$11_4$. An output gear 17*c* is connected to each of the valve shafts $13_1a$–$13_4a$ and engages a small gear of the intermediate gear 17*b*. The rotation of the drive shafts $16_1a$–$16_4a$ of the electric motors $16_1$–$16_4$ is reduced and transmitted to the throttle valves $13_1$–$13_4$ to rotate the throttle valves $13_1$–$13_4$.

The respective opening sensors $18_1$–$18_4$ formed, for example, of potentiometers are mounted to mounting portions 24, which are integrally formed with the throttle bodies $11_1$–$11_4$. The opening sensors $18_1$–$18_4$ include the driven shafts $18_1a$–$18_4a$ as detecting units connected to gears 25 which engage the aforementioned small gears of the intermediate gears 17$b$. The driven shafts $\mathbf{18}_1a$–$\mathbf{18}_4a$ are rotatably supported to supporting portions 26 formed on the throttle bodies $\mathbf{11}_1$–$\mathbf{11}_4$ via the bearings. Then, the openings of the throttle valves $\mathbf{13}_1$–$\mathbf{13}_4$ are detected from the amount of rotation of the driven shafts $\mathbf{18}_1a$–$\mathbf{18}_4a$ having the relation of 1:1 with the amount of rotation of the throttle valves $\mathbf{13}_1$–$\mathbf{13}_4$. Therefore, the opening sensors $\mathbf{18}_1$–$\mathbf{18}_4$ detect the openings of the throttle valves $\mathbf{13}_1$–$\mathbf{13}_4$ through the intermediate gears 17$b$, which are the components of the driving force transmitting mechanisms $\mathbf{17}_1$–$\mathbf{17}_4$.

Referring now to FIG. 1 and FIG. 3, in the respective throttle bodies $\mathbf{11}_1$–$\mathbf{11}_4$, the input gears 17$a$, the intermediate gears 17$b$ and the output gears 17$c$ as components of the driving force transmitting mechanisms $\mathbf{17}_1$–$\mathbf{17}_4$ are arranged in series with respect to the electric motors $\mathbf{16}_1$–$\mathbf{16}_4$ and the throttle valves $\mathbf{13}_1$–$\mathbf{13}_4$ in the direction of the arrangement A1 and are disposed on one of the side walls of the throttle bodies $\mathbf{11}_1$–$\mathbf{11}_4$ opposing with the intermediary of the air-intake channels $\mathbf{12}_1$–$\mathbf{12}_4$ in the direction of the arrangement A1, in this embodiment, on the side of left walls $\mathbf{11}_1c$–$\mathbf{11}_4c$ or the right walls $\mathbf{11}_1d$–$\mathbf{11}_4d$.

More specifically, the pair of driving motors $\mathbf{16}_1$, $\mathbf{16}_4$ and the pair of driving force transmitting mechanisms $\mathbf{17}_1$, $\mathbf{17}_4$ of the first and the fourth cylinders C1, C4 at both ends of the cylinder array B are disposed so as to have a relationship of mirror images with respect to the center plane P2. The pair of electric motors $\mathbf{16}_1$, $\mathbf{16}_4$ are disposed between the pair of driving force transmitting mechanisms $\mathbf{17}_1$, $\mathbf{17}_4$. Likewise, the pair of electric motors $\mathbf{16}_2$, $\mathbf{16}_3$ and the pair of driving force transmitting mechanisms $\mathbf{17}_2$, $\mathbf{17}_3$ belonging to the second and third cylinders C2, C3 are disposed so as to have a relationship of mirror images with respect to the center plane P2. Here, the center plane P2 is a plane located at the center of the cylinder array B in the direction of the arrangement A1 out of the planes orthogonal to the direction of the arrangement A1 and is a symmetry plane of the cylinder array B in the direction of the arrangement A1 and is located between the second and the third cylinders C2 and C3, and between the throttle bodies $\mathbf{11}_2$, $\mathbf{11}_3$.

In addition, in the first and second cylinders C1, C2 and the fourth and third cylinders C4, C3, which are both a set of the end cylinder and the adjacent cylinder, the pairs of the electric motors $\mathbf{16}_1$, $\mathbf{16}_2$; $\mathbf{16}_4$, $\mathbf{16}_3$, the pairs of driving force transmitting mechanisms $\mathbf{17}_1$, $\mathbf{17}_2$; $\mathbf{17}_4$, $\mathbf{17}_3$, and the pairs of opening sensors $\mathbf{18}_1$, $\mathbf{18}_2$; $\mathbf{18}_4$, $\mathbf{18}_3$ are disposed so as to have a relationship of mirror images with respect to the symmetry planes P1, and the pairs of electric motors $\mathbf{16}_1$, $\mathbf{16}_2$; $\mathbf{16}_4$, $\mathbf{16}_3$ and the pairs of opening sensors $\mathbf{18}_1$, $\mathbf{18}_2$; $\mathbf{18}_4$, $\mathbf{18}_3$ are located between the pairs of the driving force transmitting mechanisms $\mathbf{17}_1$, $\mathbf{17}_2$; $\mathbf{17}_4$, $\mathbf{17}_3$.

Therefore, the driving force transmitting mechanisms $\mathbf{17}_1$, $\mathbf{17}_4$ respectively are disposed leftward of the left walls $\mathbf{11}_1c$–$\mathbf{11}_4c$ in the case of the throttle body $\mathbf{11}_1$ belonging to the first cylinder C1, which is the cylinder at the left end and the throttle body $\mathbf{11}_3$ belonging to the third cylinder C3, and rightward of the right walls $\mathbf{11}_1d$–$\mathbf{11}_4d$ in the case of the throttle body $\mathbf{11}_4$ belonging to the fourth cylinder C4, which is the cylinder at the right end and the throttle body $\mathbf{11}_2$ belonging to the second cylinder C2.

The fuel injection valves 20 directed toward the suction ports $\mathbf{6}_1a$–$\mathbf{6}_4a$ for injecting fuel toward the air-intake ports $\mathbf{6}_1$–$\mathbf{6}_4$ are mounted to the upper walls $\mathbf{11}_1b$–$\mathbf{11}_4b$ of the throttle bodies $\mathbf{11}_1$–$\mathbf{11}_4$ at the position exposed to the air-intake channels $\mathbf{12}_1$–$\mathbf{12}_4$ downstream of the throttle valves $\mathbf{13}_1$–$\mathbf{13}_4$, and are connected to the delivery pipes 21 in which fuel discharged from the fuel pump and adjusted in pressure by a fuel pressure adjustor is present above the upper walls $\mathbf{11}_1b$–$\mathbf{11}_4b$.

The electric motors $\mathbf{16}_1$–$\mathbf{16}_4$, the fuel injection valves 20 and the ignition plugs are controlled by an electronic control unit (hereinafter, referred to as "ECU"). The ECU is supplied with the amount of operation of the accelerator and signals from the respective opening sensors $\mathbf{18}_1$–$\mathbf{18}_4$, various operating state sensors of the internal combustion engine E such as the speed of engine revolution or the temperature of engine and various operating state sensors of the vehicle such as the vehicle speed. Based on the signals from these sensors, the ECU controls the direction of rotation and the amount of rotation of the electric motors $\mathbf{16}_1$–$\mathbf{16}_4$ and controls the opening of the throttle valves $\mathbf{13}_1$–$\mathbf{13}_4$, and controls the amount of fuel supplied from the fuel injection valve 20 and the timing of ignition by the ignition valve.

Subsequently, the operation and effects of the embodiment configured as described above will be explained.

Since the throttle valves $\mathbf{13}_1$–$\mathbf{13}_4$ disposed in the air-intake channels $\mathbf{12}_1$–$\mathbf{12}_4$ that are provided independently for the respective cylinders C1–C4 are opened and closed by the electric motors $\mathbf{16}_1$–$\mathbf{16}_4$ that are provided independently for the throttle valves $\mathbf{13}_1$–$\mathbf{13}_4$, the respective throttle valves $\mathbf{13}_1$–$\mathbf{13}_4$ are opened and closed by the electric motors $\mathbf{16}_1$–$\mathbf{16}_4$ which are not shared by other throttle valves. Therefore, in comparison with the case in which the throttle valves $\mathbf{13}_1$–$\mathbf{13}_4$ are opened and closed by the mechanical operating mechanism using a cable or the like, the openings of the individual throttle valves $\mathbf{13}_1$–$\mathbf{13}_4$ can be controlled independently without employing a complex mechanical operating mechanism. Accordingly, various output controls according to the state of usage of the vehicle which is driven by the internal combustion engine E are enabled while getting maximum benefit from the advantage that the throttle valves $\mathbf{13}_1$–$\mathbf{13}_4$ are opened and closed by the electric motors $\mathbf{16}_1$–$\mathbf{16}_4$. Then, by controlling the openings of the throttle valves $\mathbf{13}_1$–$\mathbf{13}_4$ for the respective cylinders C1–C4, torque disalignment which may occur when the operating state of the internal combustion engine E is switched to the full cylinder operation in which all the cylinders C1–C4 are activated and the partial cylinder operation in which part of the cylinders C2, C3 are halted may be alleviated. In addition, the constraint due to the arrangement and the number of cylinders of the internal combustion engine E having the throttle valves $\mathbf{13}_1$–$\mathbf{13}_4$ opened and closed by the electric motors $\mathbf{16}_1$–$\mathbf{16}_4$ is reduced and the scope of usage of the shared components is expanded, so that the cost of the internal combustion engine E is reduced.

Since the air-intake ports $\mathbf{6}_1$, $\mathbf{6}_4$ belonging to the first and the fourth cylinders C1, C4 are formed so as to approach the center plane P2 as they approach the entrances $\mathbf{6}_1b$, $\mathbf{6}_4b$, the throttle bodies $\mathbf{11}_1$, $\mathbf{11}_4$ belonging to the first and fourth cylinders C1, C4 having the air-intake channel ports $\mathbf{12}_1$, $\mathbf{12}_4$ in communication with the air-intake ports $\mathbf{6}_1$, $\mathbf{6}_4$ can be disposed close to the center plane P2 in the direction of the arrangement A1. Thus, the width of the throttle body assembly 11 in the direction of the arrangement A1 can be reduced, so that the throttle body assembly 11 can be formed compactly in the direction of the arrangement A1.

Since the electric motors $\mathbf{16}_1$–$\mathbf{16}_4$ and the throttle valves $\mathbf{13}_1$–$\mathbf{13}_4$, which belong to the respective cylinders C1–C4 of the cylinder array B are disposed in parallel in the direction of the arrangement A1, the driving force transmitting mechanisms $\mathbf{17}_1$–$\mathbf{17}_4$ are disposed in series with respect to the electric motors $\mathbf{16}_1$–$\mathbf{16}_4$ and the throttle valves $\mathbf{13}_1$–$\mathbf{13}_4$ in the direction of the arrangement A1. In addition, the electric motors $16_1$, $16_4$ and the opening sensors $18_1$, $18_4$ belonging, respectively, to the first and fourth cylinders C1, C4 are positioned between the driving force transmitting mechanisms $17_1$, $17_4$ belonging, respectively, to the first and fourth cylinders C1, C4. Thus, the respective driving force transmitting mechanisms $17_1$, $17_4$ are positioned outside the electric motors $16_1$, $16_4$, the opening sensors $18_1$, $18_4$, and the throttle valves $13_1$, $13_4$ in the direction of the arrangement A1 as regards the first and fourth cylinders C1, C4. Therefore, the driving force transmitting mechanisms disposed between the adjacent throttle bodies $11_1$, $11_2$; $11_2$, $11_3$; $11_3$, $11_4$ in the direction of the arrangement A1 are only the driving force transmitting mechanisms $17_2$, $17_3$ which belong to the second and third cylinders C2, C3. Therefore, the number of the driving force transmitting mechanisms disposed between the throttle valves $13_1$, $13_4$ which belong, respectively, to the first and fourth cylinders C1, C4 at both ends of the cylinder array B decreases. Thus, the width of the throttle body assembly 11 in the direction of the arrangement A1 can be reduced in comparison with the case in which, for example, three or four driving force transmitting mechanisms are disposed between the adjacent throttle bodies $11_1$, $11_2$; $11_2$, $11_3$; $11_3$, $11_4$. Therefore, the throttle body assembly 11 and the internal combustion engine E can be downsized in the direction of the arrangement A1.

In the first and second cylinders C1, C2, and in the fourth and third cylinders C4, C3, which are the set of the end cylinder and the adjacent cylinder, respectively, the pairs of electric motors $16_1$, $16_2$; $16_4$, $16_3$, the pair of driving force transmitting mechanisms $17_1$, $17_2$; $17_4$, $17_3$ and the pairs of opening sensors $18_1$, $18_2$; $18_4$, $18_3$ are disposed so as to have a relationship of a mirror image with respect to the symmetry planes P1. In addition, the pairs of electric motors $16_1$, $16_2$; $16_4$, $16_3$ and the pairs of opening sensors $18_1$, $18_2$; $18_4$, $18_3$ are positioned between the pairs of the driving force transmitting mechanisms $17_1$, $17_2$; $17_4$, $17_3$. Further, the air-intake ports $6_1$; $6_4$ belonging to the first and the fourth cylinders C1: C4 and the air-intake ports $6_2$; $6_3$ belonging to the second and third cylinders C2; C3 are formed so that the air-intake ports $6_1$, $6_2$; $6_4$, $6_3$ approach the symmetry planes P1, respectively, in the direction of the arrangement A1 as they approach the entrances $6_1b$, $6_2b$; $6_4b$, $6_3b$. Therefore, the throttle bodies $11_1$, $11_2$ belonging to the first and second cylinders C1, C2 can be disposed in the vicinity in the direction of the arrangement A1 and the throttle bodies $11_4$, $11_3$ belonging to the fourth and third cylinders C4, C3 can be disposed in the vicinity in the direction of the arrangement A1. Consequently, the width of the throttle body assembly 11 in the direction of the arrangement A1 can further be reduced. Thus, the throttle body assembly 11 can further be downsized in the direction of the arrangement A1.

Since the electric motors $16_1$–$16_4$ and the opening sensors $18_1$–$18_4$ are disposed on the side of one of the opposing side walls (on the side of the lower walls $11_1a$–$11_4a$) of the throttle bodies $11_1$–$11_4$ with the intermediary of the air-intake channels $12_1$–$12_4$ and the fuel injection valves 20 and the delivery pipe 21 being disposed on the other side of the side walls (on the side of the upper walls $11_1b$–$11_4b$) when viewed the respective throttle bodies $11_1$–$11_4$ in the direction of the arrangement A1, the electric motors $16_1$–$16_4$, the opening sensors $18_1$,–$18_4$, fuel injection valves 20 and the delivery pipes 21 are disposed compactly using the spaces on both sides of the side walls $11_1a$–$11_4a$, $11_1b$–$11_4b$ in the direction orthogonal to the direction of the arrangement A1 with the intermediary of the air-intake channels $12_1$–$12_4$ in the respective throttle bodies $11_1$–$11_4$.

Since the opening sensors $18_1$–$18_4$ can detect the openings of the throttle valves $13_1$–$13_4$ from the given position in the driving force transmitting mechanisms $17_1$–$17_4$ by detecting the openings of the throttle valves $13_1$–$13_4$ through the driving force transmitting mechanisms $17_1$–$17_4$, the flexibilities of the opening sensors $18_1$–$18_4$ increase. Thus, the opening sensors $18_1$–$18_4$ can be disposed compactly in the periphery of the throttle body assembly 11.

On the side of the lower walls $11_1a$–$11_4a$ of the respective throttle bodies $11_1$–$11_4$, the electric motors $16_1$–$16_4$ and the opening sensors $18_1$–$18_4$ are disposed in series in the longitudinal direction of the air-intake channels $12_1$–$12_4$ and, in addition, at substantially the same positions with respect to the lower walls $11_1a$–$11_4a$ in the direction in which the lower walls $11_1a$–$11_4a$ and the upper walls $11_1b$–$11_4b$ oppose, or in the direction orthogonal to the direction of the arrangement A1 when viewed in the longitudinal direction (corresponding to the vertical direction in this embodiment). Therefore, the electric motors $16_1$–$16_4$ and the opening sensors $18_1$–$18_4$ can be disposed compactly on the side of the lower walls $11_1a$–$11_4a$ when viewed in the direction of the arrangement A1. In the direction of the arrangement A1, substantially the entirety of the respective electric motors $16_1$–$16_4$ and substantially the entirety of the opening sensors $18_1$–$18_4$ including the driven shafts $18_1a$–$18_4a$ are located at the positions overlapping with the throttle bodies $11_1$–$11_4$. Thus, the electric motors $16_1$–$16_4$ and the opening sensors $18_1$–$18_4$ can be arranged compactly also in the direction of the arrangement A1.

Hereinafter, an embodiment in which part of the structure of the aforementioned embodiment is modified will be described concerning the modified structure.

The multi-cylinder internal combustion engine E may be a multi-cylinder internal combustion engine other than a four cylinder engine. For example, it may be a V-type internal combustion engine in which both banks of the V-shape include the cylinder array having two or more cylinders, respectively. The driving force transmitting mechanisms $17_1$–$17_4$ may be a winding power transmitting mechanism using a pulley and an endless wire.

The fuel supply unit may be a carburetor. In this case, the throttle body corresponds to the carburetor body in which the air-intake channel in which the throttle valve is disposed is formed.

The multi-cylinder internal combustion engine E is used for a vehicle in the present embodiment. However, it may be used as a prime mover for a ship propelling unit such as a outboard motor or of other equipment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multi-cylinder internal combustion engine comprising:

a plurality of cylinders;

a cylinder array including two or more of the cylinders disposed in series;

a throttle body assembly including a predetermined number of throttle bodies formed with air-intake channels in communication with air-intake ports formed for each cylinder in a cylinder head; and throttle valves disposed in the respective air-intake channels;

wherein the respective throttle valves are opened and closed by electric motors provided independently for the respective throttle valves, the air-intake ports belonging to end cylinders located at the ends of the cylinder array in a direction of an arrangement of the cylinders of the cylinder array being formed to approach a plane positioned at the center of the cylinder array in the direction of the arrangement, which is a center plane orthogonal to the direction of the arrangement, as they approach an entrance thereof, and wherein an entrance of a respective air-intake port is formed in the cylinder head.

2. The multi-cylinder internal combustion engine according to claim 1, wherein the electric motors and the throttle valves belonging to the respective cylinders of the cylinder array are arranged in parallel in the direction of the arrangement, and further including driving force transmitting mechanisms for transmitting a driving force of the electric motors to respective throttle valves, said driving force transmitting mechanisms being arranged in series with the electric motors and the throttle valves in the direction of the arrangement and the electric motors and the throttle valves belonging respectively to the cylinders at both ends are positioned between the driving force transmitting mechanisms belonging respectively to the cylinders at both ends.

3. The multi-cylinder internal combustion engine according to claim 2, wherein the driving force transmitting mechanism for transmitting driving forces of a drive shaft connected to a respective electric motor to a throttle valve shaft connected to a respective throttle valve are gear mechanisms provided with gear trains for constituting speed reducing gear mechanisms.

4. The multi-cylinder internal combustion engine according to claim 3, wherein the gear trains each include an input gear provided on each of the drive shafts, an intermediate gear having a large gear for engaging the input gear and rotatably supported with respect to each of the throttle bodies and an output gear connected to each of the valve shafts for engaging a gear of the intermediate gear.

5. The multi-cylinder internal combustion engine according to claim 1, and further including opening sensors for detecting an opening for each throttle valve, wherein each opening sensor detects the opening of the throttle valve through the driving force transmitting mechanism for transmitting the driving force of the electric motor to the throttle valve.

6. The multi-cylinder internal combustion engine according to claim 5, wherein said opening sensors are potentiometers integrally formed with the throttle bodies and including driven shafts wherein the opening of the throttle valves is detected by the amount of rotation of the driven shafts.

7. The multi-cylinder internal combustion engine according to claim 1, wherein the electric motors are mounted below the throttle bodies and further including stays for attaching a respective electric motor to a respective throttle body.

8. A multi-cylinder internal combustion engine comprising:

a plurality of cylinders;

a cylinder array wherein two or more of the cylinders are disposed in series;

air-intake channels being in communication with air-intake ports formed in each of said plurality of cylinders;

a throttle valve disposed in each of the respective air-intake channels; and a motor independently provided relative to each of the respective throttle valves for selectively opening and closing the respective throttle valves, the air-intake ports belonging to end cylinders located at the ends of the cylinder array in the direction of an arrangement of the cylinders of the cylinder array being formed to approach a plane positioned at the center of the cylinder array in the direction of the arrangement, which is a center plane orthogonal to the direction of the arrangement, as they approach an entrance thereof, and wherein an entrance of a respective air-intake port is formed in the cylinder head.

9. The multi-cylinder internal combustion engine according to claim 8, wherein the motor and the throttle valve belonging to the respective cylinders of the cylinder array are arranged in parallel in the direction of the arrangement, and further including a driving force transmitting mechanism for transmitting a driving force of each motor to a respective throttle valve being arranged in series with the motors and the throttle valves in the direction of the arrangement and the motors and the throttle valves belonging respectively to the cylinders at both ends are positioned between the driving force transmitting mechanisms belonging respectively to the cylinders at both ends.

10. The multi-cylinder internal combustion engine according to claim 9, wherein the driving force transmitting mechanism for transmitting driving forces of a drive shaft connected to a respective motor to a throttle valve shaft connected to a respective throttle valve are gear mechanisms provided with gear trains for constituting speed reducing gear mechanisms.

11. The multi-cylinder internal combustion engine according to claim 10, wherein the gear trains each include an input gear provided on each of the drive shafts, an intermediate gear having a large gear for engaging the input gear and rotatably supported with respect to each of the throttle bodies and an output gear connected to each of the valve shafts for engaging a gear of the intermediate gear.

12. The multi-cylinder internal combustion engine according to claim 8, and further including opening sensors for detecting an opening for each throttle valve, wherein each opening sensor detects the opening of the throttle valve through the driving force transmitting mechanism for transmitting the driving force of the motor to the throttle valve.

13. The multi-cylinder internal combustion engine according to claim 12, wherein said opening sensors are potentiometers integrally formed with the throttle bodies and including driven shafts wherein the opening of the throttle valves is detected by the amount of rotation of the driven shafts.

14. The multi-cylinder internal combustion engine according to claim 8, wherein the motors are mounted below throttle bodies and further including stays for attaching a respective motor to a respective throttle body.

15. The multi-cylinder internal combustion engine according to claim 8, wherein said motors are electric motors.

16. A multi-cylinder internal combustion engine comprising:

a plurality of cylinders;

a cylinder array wherein two or more of the cylinders are disposed in series;

air-intake channels being in communication with each of said plurality of cylinders;

a throttle valve disposed in each of the respective air-intake channels; and a motor independently provided relative to each of the respective throttle valves for selectively opening and closing the respective throttle valves, the air-intake ports belonging to end cylinders located at the ends of the cylinder array in the direction of an arrangement of the cylinders of the cylinder array being formed to approach a plane positioned at the center of the cylinder array in the direction of the arrangement, wherein each motor is arranged to be symmetric with respect to an adjacent air-intake port and the arrangement of first two motors of two adjacent air-intake ports is arranged to be symmetric with respect to second two motors of two adjacent air-intake ports that are displaced a predetermined distance relative to the first two motors.

17. The multi-cylinder internal combustion engine according to claim 16, wherein the motor and the throttle valve belonging to the respective cylinders of the cylinder array are arranged in parallel in the direction of the arrangement, and further including a driving force transmitting mechanism for transmitting a driving force of each motor to a respective throttle valve being arranged in series with the motors and the throttle valves in the direction of the arrangement and the motors and the throttle valves belonging respectively to the cylinders at both ends are positioned between the driving force transmitting mechanisms belonging respectively to the cylinders at both ends.

18. The multi-cylinder internal combustion engine according to claim 17, wherein the driving force transmitting mechanism for transmitting driving forces of a drive shaft connected to a respective motor to a throttle valve shaft connected to a respective throttle valve are gear mechanisms provided with gear trains for constituting speed reducing gear mechanisms.

19. The multi-cylinder internal combustion engine according to claim 16, and further including opening sensors for detecting an opening for each throttle valve, wherein each opening sensor detects the opening of the throttle valve through the driving force transmitting mechanism for transmitting the driving force of the motor to the throttle valve.

20. The multi-cylinder internal combustion engine according to claim 16, wherein the motors are mounted below throttle bodies and further including stays for attaching a respective motor to a respective throttle body.

21. A multi-cylinder internal combustion engine comprising:

a plurality of cylinders;

a cylinder array including two or more of the cylinders disposed in series;

a throttle body assembly including a predetermined number of throttle bodies formed with air-intake channels in communication with air-intake ports formed for each cylinder in a cylinder head; and throttle valves disposed in the respective air-intake channels;

wherein the respective throttle valves are opened and closed by electric motors provided independently for the respective throttle valves, the air-intake ports belonging to end cylinders located at the ends of the cylinder array in a direction of an arrangement of the cylinders of the cylinder array being formed to approach a plane positioned at the center of the cylinder array in the direction of the arrangement, which is a center plane orthogonal to the direction of the arrangement, as they approach an entrance thereof, and wherein the electric motors drive corresponding gear mechanisms associated with the respective throttle valves to independently open and close the respective throttle valves.

* * * * *